United States Patent [19]

Perez

[11] 4,287,630

[45] Sep. 8, 1981

[54] PIPE CLEANING APPARATUS

[76] Inventor: Thomás Pérez, 3310 NW. 9 Ct., Miami, Fla. 33127

[21] Appl. No.: 86,991

[22] Filed: Oct. 22, 1979

Related U.S. Application Data

[63] Continuation of Ser. No. 906,241, May 15, 1978, abandoned.

[51] Int. Cl.[3] ..... B08B 9/02

[52] U.S. Cl. ..... 15/104.3 SN

[58] Field of Search ..... 15/104.3 SN, 104.3 R

[56] References Cited

U.S. PATENT DOCUMENTS

| | | | |
|---|---|---|---|
| 2,245,823 | 6/1941 | Rappaport | 15/104.3 SN |
| 2,284,939 | 6/1942 | Asnard | 15/104.3 SN |
| 2,470,225 | 5/1949 | Silverman | 15/104.3 SN |
| 2,828,133 | 3/1958 | Silverman | 15/104.3 SN |
| 3,224,024 | 12/1965 | Hunt | 15/104.3 SN |
| 3,691,583 | 9/1972 | Silverman et al. | 15/104.3 SN |

*Primary Examiner*—Edward L. Roberts
*Attorney, Agent, or Firm*—John Cyril Malloy

[57] ABSTRACT

An attachment for the chuck of a drill composed of a reaming tool, said reaming tool including a housing defining an internal chamber and having an upper portion and a lower portion, said upper portion including structure adapted to attach to the chuck for rotation therewith and said lower portion including an open cylindrical axially extending portion of a first predetermined axial length and in open communication with the chamber of the housing, and a snake having a first end and intermediate portion in said chamber and a second end extending outwardly of the cylindrical portion; the snake being loose in said housing and cylindrical portion, and sleeve means arranged about said cylindrical portion and having a radially extending handle; said sleeve means being of a shorter length than said cylindrical portion so that a portion of said cylindrical portion extends beyond said sleeve, and fastening means to connect the snake through the extending portion of the cylindrical member for rotation of the snake with the housing and releasable for manual axial advancement of the snake relative to the cylindrical portion and sleeve for adjustment axially of the snake.

1 Claim, 2 Drawing Figures

PIPE CLEANING APPARATUS

This is a continuation application of my copending patent application Ser. No. 906,241 filed May 15, 1978 now abandoned.

FIELD OF THE INVENTION

An attachment for the chuck of a drill housing comprising a reaming tool.

BACKGROUND OF THE INVENTION

In the past there have been numerous devices for use with drills to act as reaming tools. This invention is of such a device.

It is, accordingly, an object of this invention to provide an improved reaming tool composed of a snake which is adapted to be rotated together with a housing to be attached to the chuck of a drill and, alternatively, to be disconnected from the housing to be axially advanced, and wherein the snake is free to move within the housing and an axially extending cylindrical portion when not clamped into engagement for rotation with the housing upon rotation of the drill, all as is explained more fully hereinafter.

In accordance with these and other objects which will become apparent hereinafter, the instant invention will now be described with reference to the accompanying drawing, in which:

DESCRIPTION OF THE PREFERRED EMBODIMENT

Figure 1:
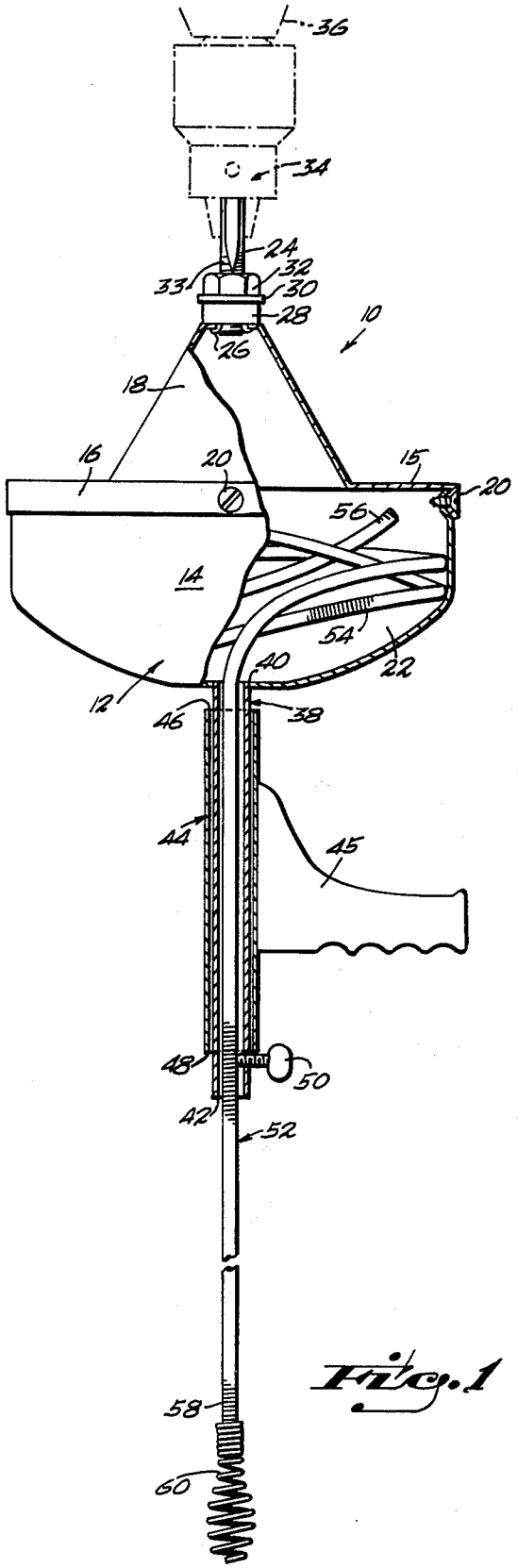
FIG. 1 is a side elevation view, partly broken away and illustrating the invention.
Figure 2:
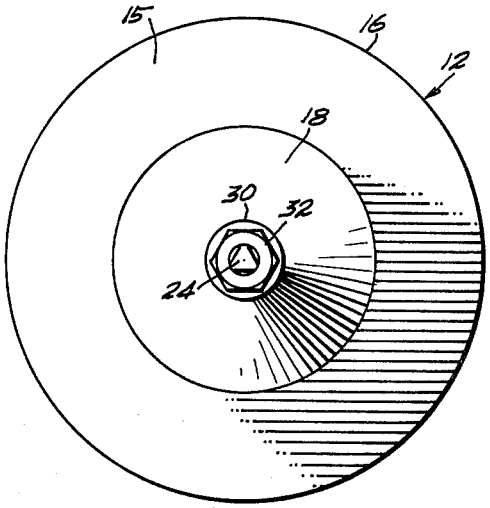
FIG. 2 is a top plan view of the invention shown in FIG. 1.

Referring to the drawings wherein like reference characters designate like or corresponding parts throughout the several views and referring particularly to FIG. 1, the device is generally designated by the numeral 10. It is seen to contain a container generally designated by the numeral 12 which is composed of a housing 14 with a lid 15 secured by means of the flange 16 and screws 20 to the housing and that the lid includes a frusto-conical top 18. There is defined an interior chamber 22 and a stem 24 which extends from the frustoconical top 18, the stem being welded to the lid as at 26 and there being a collar 28 provided in combination with a washer 30 and nut 32 on the threads 33 of the stem 24. The stem is adapted to be received in a chuck 34 of a drill 36. Extending from the container there is a tube 38 which is fixed to it with an opening 40 into the interior chamber 22 and the tube has an open bottom 42. About the extending stem is a loose sleeve 44 from which there extends radially a handle 45. The top of the sleeve is designated by the numeral 46 and the bottom is designated by the numeral 48 and it is captivated by means of a set screw 50 receivable in a threaded screw bore of the stem 24. A snake 52 with a portion in the chamber 22 is provided, it being noted that the inner 56 is free and that the outer end 58 is provided with a reaming coil 60.

What is claimed is:

1. An attachment for the chuck of a drill comprising:

a reaming tool, the reaming tool including a housing defining an interior chamber, the interior chamber having an upper portion and a lower portion, the upper portion including means exterior of the housing for attaching to the chuck for rotation therewith, and the lower portion including an open cylindrical axially extending tubular portion of a first predetermined axial length in open communication with the interior chamber, and of a first predetermined inside diameter, a snake having a first end, an intermediate portion in the interior chamber and a second end extending through the cylindrical tubular portion; the snake being loose in the interior housing and the cylindrical portion, and being of an outside diameter slightly less than said first prediameter, said second end comprising a reaming coil, sleeve means arranged circumferentially about the cylindrical tubular portion having a radially extending hand grip handle; the sleeve means being a shorter length than the cylindrical tubular portion with a portion of the cylindrical tubular portion extending beyond the sleeve means at all times in use, and fastening means to connect the snake axially within the tubular portion for rotation of the snake with the housing and said fastening means being adapted to release the snake for relative axial advancement of the snake relative to the tubular cylindrical portion, said fastening means comprising a hole in the extending length of said cylindrical member and a screw in threaded engagement in said hole, said screw having an exteriorly accessible portion and said screw having an inner end in engagement with the snake to constrain the snake to rotation with the cylindrical portion on rotation of the housing and being adapted to be withdrawn for axial movement of advancement of the snake relative to the housing, said upper portion comprising a frustoconical top being in open communication with the interior chamber, and said frustoconical top including an upper portion having means for attachment of said upper portion for rotation with the chuck.

* * * * *